United States Patent [19]

Cohen

[11] Patent Number: 4,754,559

[45] Date of Patent: Jul. 5, 1988

[54] SHOE WITH MIDSOLE INCLUDING DEFLECTION INHIBITING INSERTS

[76] Inventor: Eli Cohen, 350 Continental Ave., Paramus, N.J. 07652

[21] Appl. No.: 54,808

[22] Filed: May 27, 1987

[51] Int. Cl.[4] ..... A43B 13/18; A43B 7/08

[52] U.S. Cl. ..... 36/3 B; 36/25 R; 36/28

[58] Field of Search ..... 36/28, 29, 3 R, 3 B, 36/31, 102, 103

[56] References Cited

U.S. PATENT DOCUMENTS

| | | | |
|---|---|---|---|
| 625,393 | 5/1899 | Haferteren | 36/3 R |
| 2,968,105 | 1/1961 | Rizzo | 36/29 |
| 3,087,262 | 4/1963 | Russell | 36/28 |
| 3,172,217 | 3/1965 | Colman | 36/28 |
| 4,229,889 | 10/1980 | Petrosky | 36/28 |
| 4,451,994 | 6/1984 | Fowler | 36/102 |
| 4,535,553 | 8/1985 | Derderian et al. | 36/28 |
| 4,593,482 | 6/1986 | Mayer | 36/29 |
| 4,611,412 | 9/1986 | Cohen | 36/28 |
| 4,638,577 | 1/1987 | Riggs | 36/28 |

FOREIGN PATENT DOCUMENTS

| | | | |
|---|---|---|---|
| 958766 | 9/1949 | France | 36/28 |
| 8101234 | 5/1981 | PCT Int'l Appl. | 36/29 |

*Primary Examiner*—Steven N. Meyers

*Attorney, Agent, or Firm*—Hoffman, Wasson & Fallow

[57] ABSTRACT

A shoe containing a plurality of pairs of ribs provided between the mid-sole and the outer sole. All of the ribs are provided with at least one bowed or convex surface running the length of the rib. When weight is placed upon the sole, each of the ribs initially begins to deflect until adjacent ribs abut one another at which the ribs begin to compress. An elastic bridging element is provided between each of the ribs provided in a single pair of ribs. Additionally, tubes or plug inserts are provided between at least one pair of ribs or between adjacent rib pairs.

8 Claims, 5 Drawing Sheets

(RELAXED STATE)

(COMPRESSED STATE)

(RELAXED STATE)

(COMPRESSED STATE)

(RELAXED STATE)

(COMPRESSED STATE)

(COMPRESSED STATE)

(RELAXED STATE)

(RELAXED STATE)

(COMPRESSED STATE)

SHOE WITH MIDSOLE INCLUDING DEFLECTION INHIBITING INSERTS

BACKGROUND OF THE INVENTION

For the last several years, we have witnessed a great increase in the amount of people who either run or jog as a recreational sport. However, concommitant with this increase, is a large number of injuries or conditions which are produced from utilizing athletic shoes which do not properly cushion the user's feet.

As is recognized by those skilled in the art, as well as those millions of recreational runners, good impact absorption and flexibility are two extremely important characteristics desired in both athletic as well as nonathletic shoes. Both of these shoe soles should permit a great deal of flexibility at the point where the foot naturally flexes, while being sufficiently tough to withstand shock, yet soft enough to provide adequate cushioning and comfort. This flexible, yet strong feature is very useful in nonathletic, as well as athletic shoes. Additionally, the shoe sole should control pronation and supination of the foot as well as providing locational resistance to exceptional strike forces, particularly in the heel area.

The sole structure of most shoes commercially available today is a tripartite construction including an outer sole, a mid-sole and an inner sole. The outer sole is normally formed of a tough, abrasion-resistant material, since it is the portion of the sole which contacts the ground. The mid-sole is the portion of the shoe between the outer sole and the inner sole and its function is to provide lift for the heel and cushioning for the entire shoe. The inner sole is normally used to join the mid-sole to the shoe structure itself.

Most mid-soles commercially available at the present time utilize a single layer of compressionable rubber-like or similar material. The force needed to initially compress this material is minimal, but as additional force is placed upon the material, a greater amount of force is needed to further compress the material.

Prior art shoes show the use of either mid-soles or outer soles which are provided with ribs or ridges which contain at least one portion which is slanted with respect to the normal plane of the shoe. These particular shoe sole designs initially deflect when a force is applied to the sole. Contrary to the compressive force, the force initially used to cause a deflection of the ribs or ridges is rather large, but as additional force is applied, the average amount of force needed to produce additional deflection lessens.

Although some of the prior art shoes include the ribs provided in the shoe sole which initially abut with neighboring ribs at the outer sole line, these ribs do not initially deflect and then when additional force is applied abut adjacent ribs provide a compressive force which must be overcome by the individual wearing the shoes.

While it has been determined that the use of a material able to deflect when force is applied thereto provides a better cushioning surface than utilizing a single sheet of material for the mid-sole, it has also been determined that a shoe which provides even more cushioning must be developed.

SUMMARY OF THE INVENTION

Broadly, the present invention combines the teaching of the prior art single sheet mid-sole with that of the prior art mid-sole containing a plurality of ribs capable of being deflected.

The present invention accomplishes this end by providing a mid-sole containing a plurality of pairs of ribs, each pair of ribs containing oppositely bowed, arcuate or convex-shaped material. These pairs of ribs are spaced from adjacent pairs of ribs such that after each rib has been deflected, it intrudes upon a rib of an adjacent pair. In this manner, each rib of the mid-sole would initially be deflected and then when it abuts an adjacent rib, compression of these ribs would take place. These rows of ribs are provided transverse to the longitudinal axis of the shoe, parallel to the longitudinal axis of the shoe or at various angles with respect to the longitudinal axis of the shoe.

Additionally, the present invention controls pronation and supination of the foot, as well as provides for localized resistance to exceptional strike forces by providing inserts between the ribs of a single pair or pairs of ribs or between adjacent rib pairs.

Furthermore, when the inserts are placed between adjacent rib pairs, they are adapted to substantially or completely fill the entire volume between the adjacent rib pairs to inhibit the deflection of the ribs of the mid-sole. This embodiment effects a method for selectively creating differential resistance which is used to customize the mid-sole to an individual or a specific activity.

Other objects and many of the attendant advantages of the instant invention will be readily appreciated as it becomes better understood by reference to the following detailed description when considered in connection with the accompanying drawings.

DETAILED DESCRIPTION OF THE INVENTION

Figure 1:
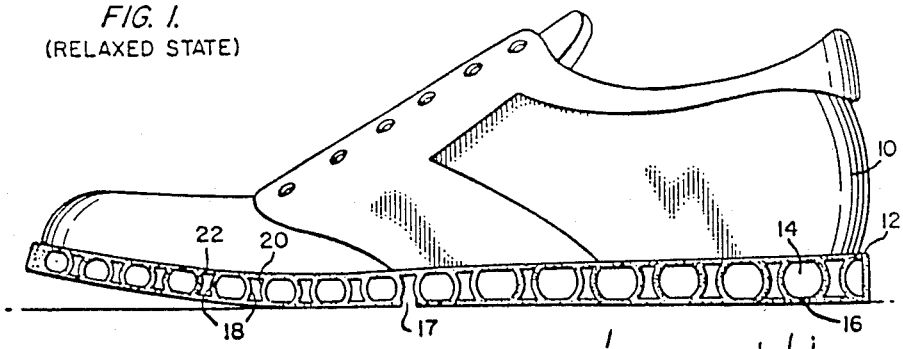
FIGS. 1, 3, 5 and 8 show various embodiments of the present invention in the undeflected and uncompressed state.

As shown in FIG. 1, a shoe 10 is provided with an inner sole 12, a mid-sole 14 and an outer sole 16. The inner sole 12 consists of a sheet of rubber or leather material. The mid-sole 14 contains a plurality of pairs of ribs 18. These ribs are transverse to the longitudinal axis of the shoe and are applied over virtually the entire length of the shoe. Additionally, in one embodiment each pair of ribs run for substantially the entire width of the shoe, or in a second embodiment explained heretofore, the ribs do not run the entire width of the shoe. Although it is not crucial for the invention, each pair of ribs is constructed from a rubber-like or similar material. As shown in FIG. 1, each of the ribs of the pair of ribs 18 is bowed oppositely with respect to one another. The outer sole 16 is also constructed from a variety of materials commonly utilized by athletic as well as non-athletic shoes. Alternatively, the inner sole 12, the mid-sole 14 and the outer-sole 16 can be extruded as an entire unit.

Figure 2:
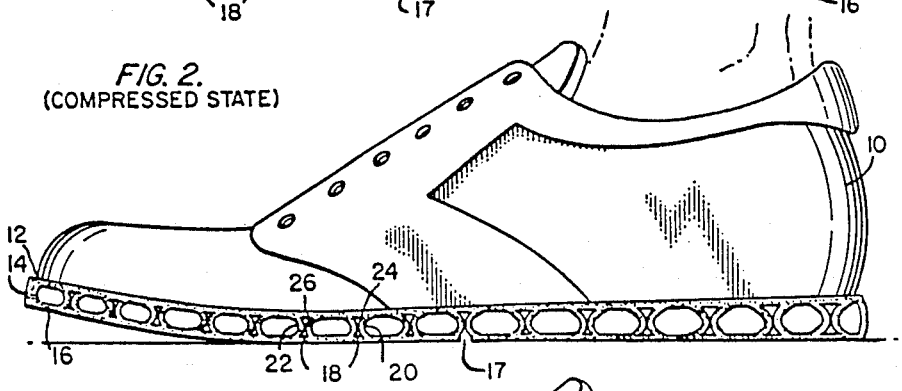
FIGS. 2, 4, 6 and 9 show various embodiments of the present invention in the deflected and compressed state.

When an individual walker, runner or jogger applies force normal to the soles, as is shown in FIG. 2, each of the ribs initially deflects. As indicated hereinabove, a relatively large force is needed to initially deflect the ribs, but as the ribs are deflected to a greater extent, relatively less force is needed to deflect the ribs further. Each pair of ribs is separated from adjacent pairs of ribs such that after a predetermined force has been applied, one of the pairs of ribs 18 intrudes upon an adjacent rib 20 of a second pair of ribs at 24, while the second rib of the pair 18 intrudes upon its adjacent rib 22 of a third pair of ribs at 26. From this point on, as additional force is applied normal to the sole, the ribs will be compressed. Since a minimal amount of force is needed for the ribs to initially be compressed and a continually greater amount of force is needed to further compress the ribs, the particular configuration of the mid-sole of the present invention provides a sole in which a relatively constant amount of force is needed to both deflect and compress the sole as force is applied to the sole while the individual is running, walking or jogging.

The ultimate result of this sole, which requires a relatively great amount of pressure followed directly by a relatively light amount of pressure needed to deflect the ribs coupled with the relatively small amount of pressure followed by a relatively large amount of pressure necessary to compress the ribs, produces a sole which is light, inexpensive and is capable of achieving an extremely soft and even step.

Figure 3:
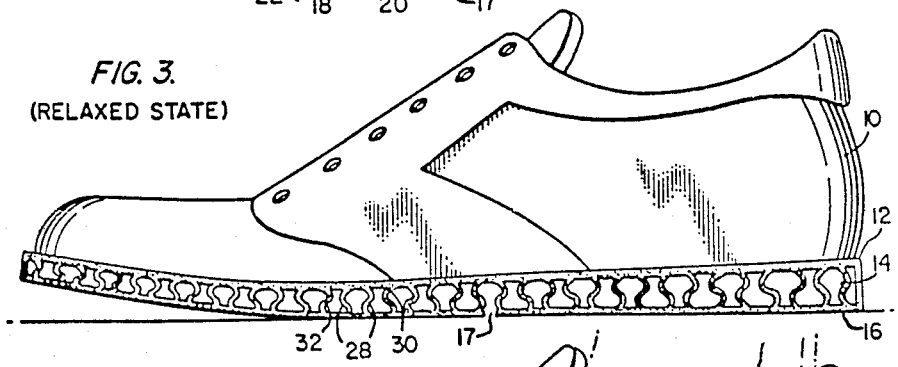
Figure 4:
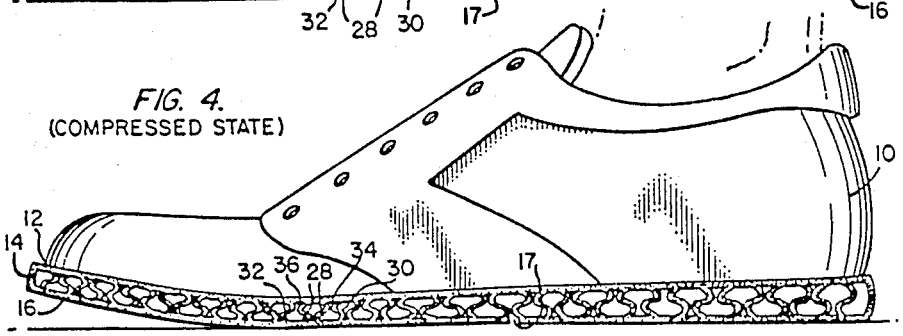
Figure 5:
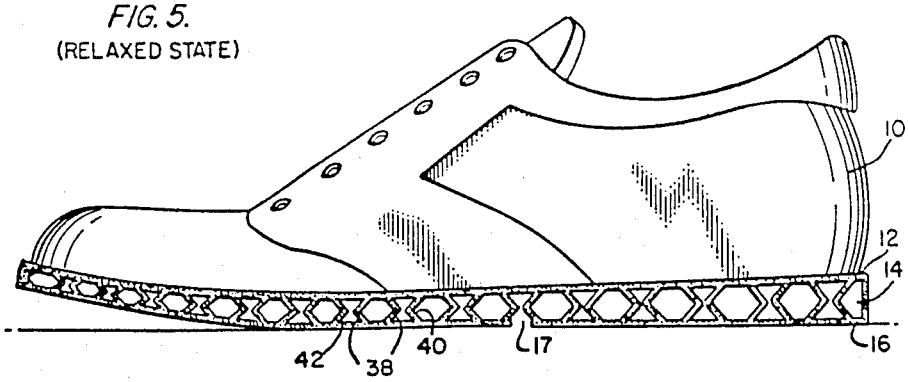

FIGS. 3 and 5 show different embodiments of the present invention. FIG. 3 shows a shoe in which each of a pair of ribs 28 contains one forwardly facing contoured "S"-shaped rib and an oppositely facing contoured "S"-shaped rib. As was true with respect to the shoe described in FIGS. 1 and 2, each of the ribs is initially deflected until adjacent ribs 30 and 32 abut at 24 and 26, at which point any additional force applied to the sole would act as a force to compress the ribs 28 of the mid-sole 14, as is shown in FIG. 4.

Figure 6:
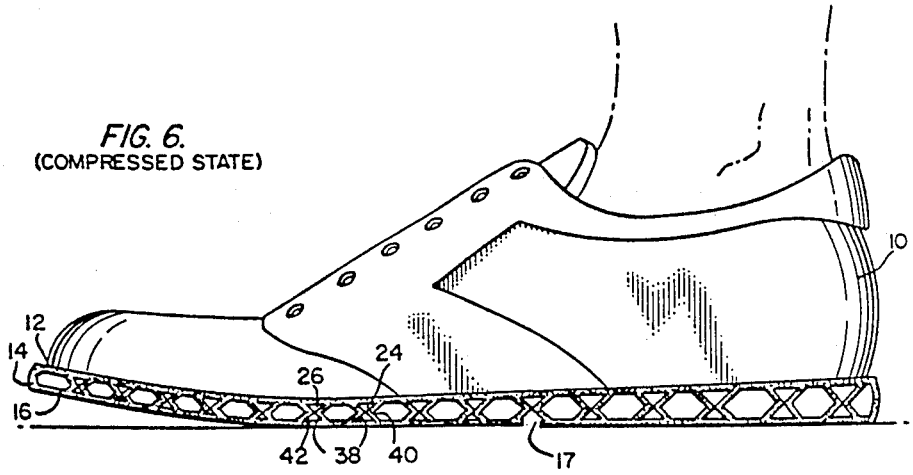

Similarly, FIG. 5 shows a shoe 10 provided with a plurality of pairs of ribs 38, each pair of ribs forming a "diamond" design. Furthermore, as was true with respect to the shoes shown in FIGS. 1–4, this "diamond" design would initially deflect when force is provided normal to the sole until adjacent ribs 40 and 42 intrude upon the ribs 38 at 24 and 26, respectively, at which time the ribs 38 of the mid-sole 14 would compress, as is shown in FIG. 6.

Each of the outer soles 16 can be provided with one or more transverse slits 17, to reduce the effort required to flex the shoe during the normal heel-raising mode used in running or walking.

Figure 7:
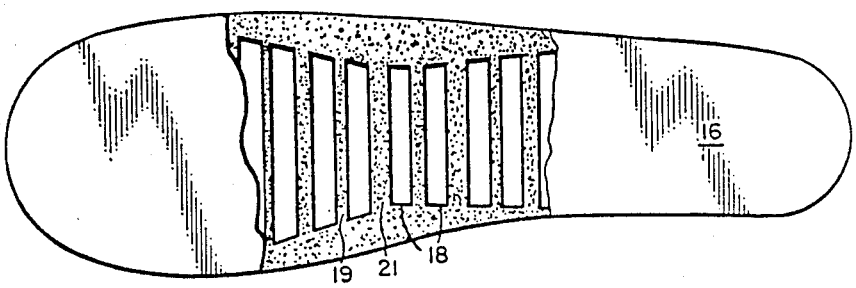
FIG. 7 is a cut away view showing the ribs of the shoe.
Figure 9:
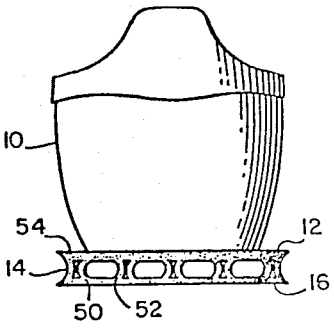
Figure 8:
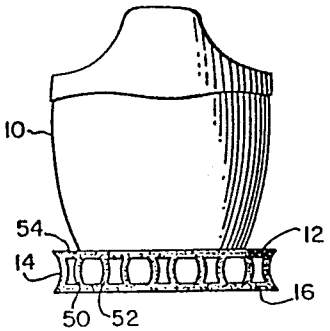

While the embodiments shown in FIGS. 1–7 illustrate a shoe sole having a plurality of ribs provided transverse to the longitudinal axis of the shoe sole, running substantially the entire width of the sole, it is noted that these ribs need not be so situated. FIGS. 8 and 9 show an embodiment in which a plurality of ribs 50, 52 are provided parallel to the longitudinal axis of the shoe sole, running substantially the entire length of the sole. As shown in FIGS. 8 and 9, the inner sole 12, the mid-sole 14 and the outer sole 16 extend slightly beyond the shoe body as shown at 54. The purpose of this extension is to provide greater support and control the pronation of the individual user.

Figure 10:
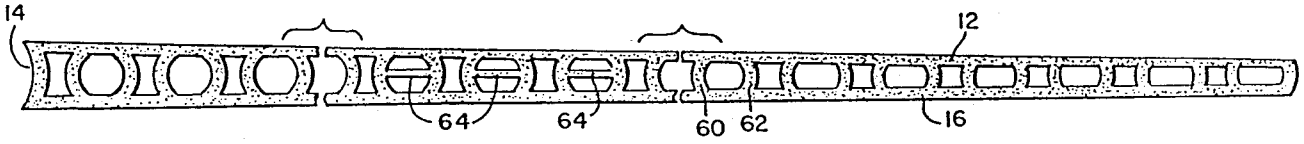
FIG. 10 is a side-elevational, break-away view of the shoe sole.
Figure 11:
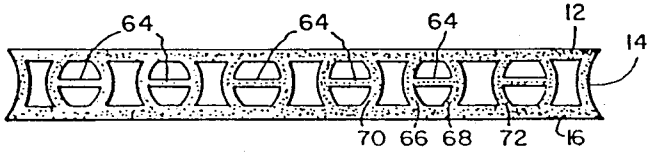
FIG. 11 is a side-elevational view of the ribs of the shoe sole.

FIG. 10 shows a side-elevational view of the mid-sole 14 provided with the type of ribs 60, 62 shown in FIGS. 1, 2, 8 and 9. A thin elastic bridging element 64 is provided between each of the ribs 60, 62 provided in a single pair of bowed ribs. All of the pairs of ribs contain similar bridging elements. The bridging elements are thinner than each individual rib and the elastic nature of the element allows them to be stretched when the ribs 60, 62 are initially deflected and then compressed to provide another complementary cushioning force to that of the deflection of the ribs. Furthermore, as shown in FIG. 11, if the ribs are spaced further apart than is shown in FIG. 10, the bridging elements 64 are used only in conjunction with the deflective forces of the ribs 66, 68, 70 and 72. In this situation, regardless of the amount of pressure or force which is applied to the shoe sole, rib 66 will not abut rib 70 and similarly, rib 68 will not abut rib 72.

Although the exact dimensions of the rib and sole size are not crucial, it has been determined that with the exception of approximately the last four ribs on the right side of the shoe sole shown in FIG. 10, all of the ribs are approximately $\frac{1}{8}$ inch in thickness, and these last several ribs are 3/16 inch in thickness. Furthermore, the spacing between ribs 60 and 62 which are $\frac{1}{8}$ inch in thickness is $\frac{1}{4}$ inch in the relaxed state and the spacing between ribs which are 3/16 inch in thickness are slightly less than $\frac{1}{4}$ inch. The purpose of the slightly thickened ribs are to help prevent pronation and support the individual's foot more completely. Additionally, the inner-sole 12 could be 3/32 inch in thickness and the outer sole 16 is $\frac{1}{8}$ inch in thickness.

Shoes constructed according to the present invention could provide a varying degree of cushioning needed to compensate for different shock loads produced as different portions of the shoe contact the ground during athletic or other endeavors. Additionally, the spacing between each pair of ribs as well as the thickness of the ribs and the length of the ribs can be increased or decreased depending upon the weight of the individual, or the particular activity for which the shoe is designed. It is this interaction of each pair of ribs with their adjacent ribs which produces the particular cushioning connection and not the action of any hydraulic or pneumatic force.

FIGS. 12–15 illustrate further embodiments of the present invention in which solid elastomeric plug inserts are used to control pronation and supination of the foot as well as to provide localized resistance to exceptional strike forces, particularly in the heel area.

Figure 12:
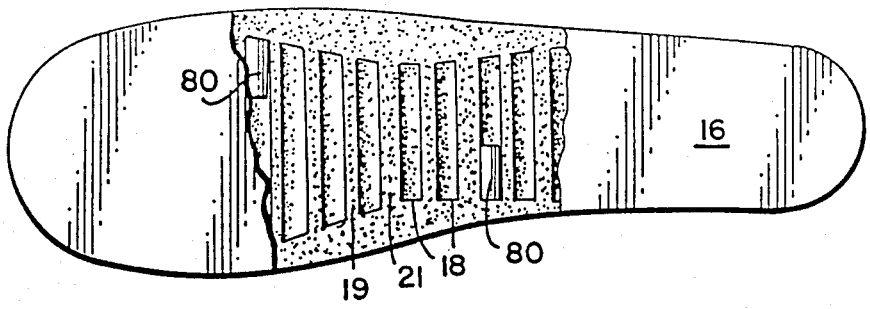
FIG. 12 is a cut-away view showing traverse ribs and the inserts of the shoe.

As shown in FIG. 12, tubes 80 are placed between the ribs 18 which extend along width of the mid-sole. The tubes 80 could extend along the entire width of the shoe, or, as illustrated in FIG. 12, can be provided between the first and second ribs of a rib pair 18 for only a portion of the width. Additionally, as shown, the tubes 80 need not be provided between each pair of ribs, but the placement and length of each tube is predicated upon the type of activity contemplated as well as the physical characteristics of the user.

Figure 15:
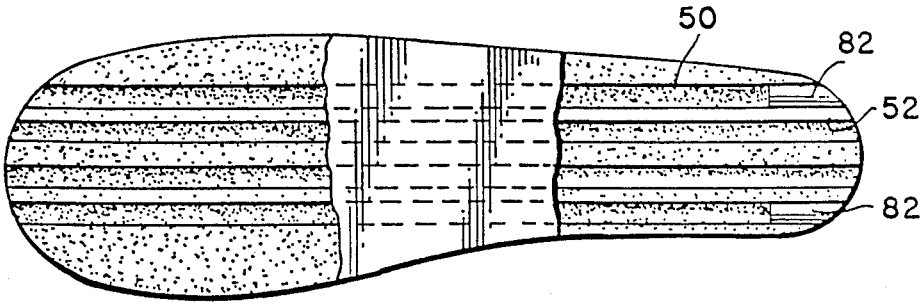
FIG. 15 is a cut-away view of FIG. 13 showing the longitudinal ribs and the inserts of the shoes.

Furthermore, as illustrated in FIG. 15, elastomeric insert tubes 82 can be provided between longitudinally extending ribs 50, 52. Similar to the embodiment shown with respect to FIG. 12, tubes 82 need not be provided between all the pairs of ribs, nor must they extend for the entire length of the sole.

Figure 13:
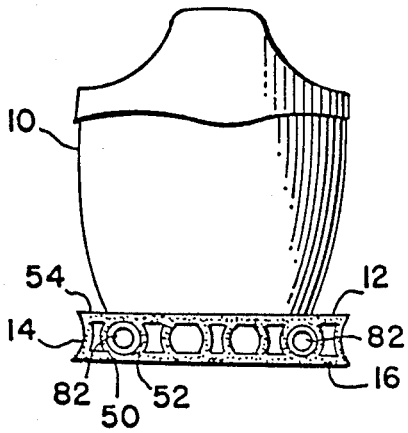
FIG. 13 shows the shoe provided with longitudinal ribs and inserts in the relaxed state.
Figure 14:
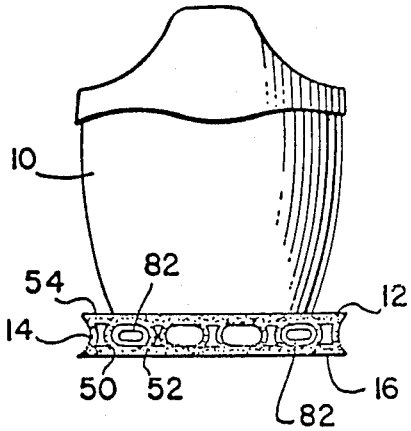
FIG. 14 shows the shoe provided with longitudinal ribs and inserts in the compressed state.

FIG. 13 and 14 show the shoe and shoe sole including the tubes 82. FIG. 13 illustrates the shoe in the relaxed state, and FIG. 14 shows the shoe in the compressed state illustrating the flexibility of the tubes 82.

As previously indicated, the length of the tube inserts is not critical; although it has been determined that a tube length of one inch provides satisfactory results. Additionally, the wall thickness of the tubes can be altered to accommodate varying sport activities, weight distribution, as well as the compression load per square inch for any specific individual.

Additionally, solid plug inserts can be substituted for the tube inserts. The plug inserts can be constructed from sponge rubber or similar material whereas the tube inserts are provided with an open interior permitting the free passage of air therethrough.

The plugs or tubes can be inserted between the ribs of the mid-sole during manufacture and are fixedly attached thereto by glue, an adhesive or similar material. Alternatively, the plug or tubes can be manually inserted between the ribs by the individual user. The tubes or plugs can be adhesively attached to the ribs, the inner sole or the outer sole or, alternatively, would remain in place due to friction. Therefore, depending upon the activity which is contemplated, the number, placement length as well as physical construction of the plugs or tubes, can be altered accordingly.

Figure 16:
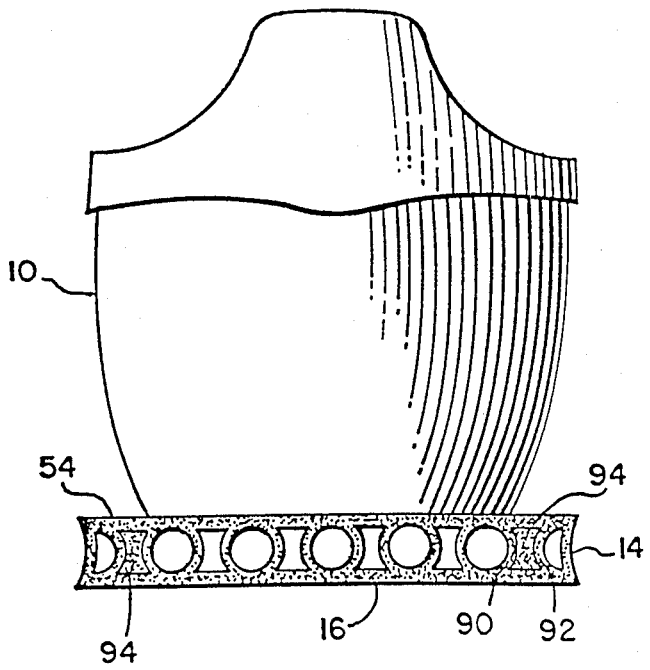
FIG. 16 shows the shoe provided with longitudinal ribs and deflection inhibiting inserts provided between adjacent rib pairs.

Yet another embodiment of the present invention is illustrated with respect to FIG. 16. This embodiment employs a deflection inhibiting insert 94 provided between two adjacent rib pairs. The insert is inserted into the mid-sole between rib 90 of one pair of ribs and rib 92 of an adjacent pair of ribs. The insert 94 is constructed from a rubber or sponge-like compressible material similar to that of the plug insert and is adapted to substantially fill the void between ribs 90 and 92. Initially, when force is applied to the mid-sole, the ribs 90 and 92 would deflect until they abut one another and then the ribs would begin to compress. However, when the insert 94 is provided between ribs of adjacent rib pairs, deflection of the ribs is retarded and a differential resistance is created. By utilizing inserts of varying length and placement, as well as material, the resistance can be used to customize the mid-sole to a particular individual or specific activity. Although this embodiment has been illustrated with respect to a mid-sole provided with longitudinal ribs, it can also be employed with a mid-sole having transverse ribs. Furthermore, the deflection inhibiting inserts 94 can be used with various configurations of ribs as long as one rib of each pair is angled with respect to the second rib of each rib pair. Additionally, although the embodiment of FIG. 16 works particularly well with solid inserts 94, these inserts could conceivably be replaced by tubes inserts.

Furthermore, it should be noted that various other configurations of the mid-sole can be utilized as long as the mid-sole is initially deflected until each rib intrudes upon an adjacent rib, at which time the ribs of the mid-sole will begin to be compressed if further force is applied thereto. For example, the ribs 18 can be variably spaced from one another or be of varying length for maximum cushioning effect, or they can be of varying thickness for specific weight loads. Additionally, the spacing and length of the ribs can be altered depending upon the particular nature of the sport or activity to which the shoe will be put to use. As shown in FIG. 7, the spacing 19 between the two ribs is less than the spacing 21 between two additional ribs. Furthermore, the length of each of the ribs can vary with respect to one another. Additionally, although all of the figures illustrate a shoe sole having ribs either parallel or transverse to the longitudinal axis of the shoe sole, these ribs could be provided at various angles with respect to the longitudinal axis. Furthermore, the tubes or inserts described hereinabove can be securely inserted when the shoe sole is manufactured or can be inserted into the mid-sole directly by the end user.

While this invention has been described with particular reference to the construction shown in the drawings, it is to be understood that such is not to be construed as imparting limitations upon the invention.

What is claimed is:

1. A sole component for a shoe comprising:

an inner sole provided directly underneath the shoe;

a mid-sole provided directly underneath said inner sole, said mid-sole provided with a plurality of pairs of parallel ribs and one insert member, each of said pairs of ribs comprising first and second ribs, said first rib of one of said pairs of ribs provided with at least one portion angled with respect to said inner sole, and said second rib of said one of said pairs of ribs provided with at least one portion angled with respect to said inner sole and angled oppositely and away from said angled portion of said first rib, each of said pairs of ribs spaced from adjacent pairs of ribs, and wherein said insert member is provided between a first rib of one of said pairs of ribs and a second rib of a second pair of said ribs, said first pair of ribs being adjacent to said second pair of ribs; and an outer sole provided directly underneath said mid-sole.

2. The sole component in accordance with claim 1 wherein said insert member substantially fits in the space between a first rib of one of said pairs of ribs and a second rib of a second pair of ribs, said first pair of ribs being adjacent to said second pair of ribs.

3. The sole component in accordance with claim 1 wherein each of said pairs of ribs and said insert member extends along the longitudinal axis of said shoe.

4. The sole component in accordance with claim 1 wherein each of said pairs of ribs and said insert member extends along the transverse axis of said shoe.

5. A sole component for a shoe comprising:

an inner sole provided directly underneath the shoe;

a mid-sole provided directly underneath said inner sole, said mid-sole provided with a plurality of pairs of parallel ribs and a plurality of insert members, each of said pairs of ribs comprising first and second ribs, said first rib of one of said pairs of ribs provided with at least one portion angled with respect to said inner sole, and said second rib of said one of said pairs of ribs provided with at least one portion angled with respect to said inner sole and angled oppositely and away from said angled portion of said first rib, each of said pairs of ribs spaced from adjacent pairs of ribs, and wherein each of said plurality of insert members is provided between a first rib of one of said pairs of ribs and a second rib of a second pair of said ribs, said first pair of ribs being adjacent to said second pair of ribs; and an outer sole provided directly underneath said midsole.

6. The sole component in accordance with claim 5 wherein each of said plurality of insert members substantially fits in the space between a first rib of one of said pairs of ribs and a second rib of a second pair of ribs, said first pair of ribs being adjacent to said second pair of ribs.

7. The sole component in accordance with claim 5 wherein each of said pairs of ribs and each of said plurality of insert members extends along the longitudinal axis of said shoe.

8. The sole component in accordance with claim 5 wherein each of said pairs of ribs and each of said plurality of insert members extends along the trasverse axis of said shoe.

* * * * *